US006137193A

United States Patent [19]

Kikuoka et al.

[11] Patent Number: 6,137,193

[45] Date of Patent: Oct. 24, 2000

[54] CONTROLLER FOR RELAY

[75] Inventors: Mitsuhiko Kikuoka; Satoru Shibata, both of Yawata, Japan

[73] Assignee: Matsushita Electric Industrial Co., Ltd., Osaka, Japan

[21] Appl. No.: 09/297,902

[22] PCT Filed: Sep. 7, 1998

[86] PCT No.: PCT/JP98/03995

§ 371 Date: Jun. 11, 1999

§ 102(e) Date: Jun. 11, 1999

[87] PCT Pub. No.: WO99/13482

PCT Pub. Date: Mar. 18, 1999

[30] Foreign Application Priority Data

| | | | |
|---|---|---|---|
| Sep. 8, 1997 | [JP] | Japan | 9-242431 |
| Nov. 27, 1997 | [JP] | Japan | 9-325725 |
| Jul. 28, 1998 | [JP] | Japan | 10-212149 |

[51] Int. Cl.[7] ..... H01H 47/12

[52] U.S. Cl. ..... 307/137; 361/170

[58] Field of Search ..... 307/125, 137; 361/160, 170, 179

[56] References Cited

U.S. PATENT DOCUMENTS

| | | | |
|---|---|---|---|
| 4,914,315 | 4/1990 | Nickolai | 301/137 |
| 5,777,301 | 7/1998 | Kim | 219/721 |

FOREIGN PATENT DOCUMENTS

| | | |
|---|---|---|
| 59-194324 | 11/1984 | Japan . |
| 1-77241 | 5/1989 | Japan . |
| 3-89425 | 4/1991 | Japan . |
| 9-259724 | 10/1997 | Japan . |
| H9-306322 | 11/1997 | Japan . |

OTHER PUBLICATIONS

Japanese Search Report corresponding to application No. PCT/JP98/03995 dated Dec. 15, 1998.

Copy/Form PCT/ISA/210.

*Primary Examiner*—Stephen W. Jackson
*Assistant Examiner*—Robert L. DeBeradinis
*Attorney, Agent, or Firm*—Ratner & Prestia

[57] ABSTRACT

A relay control circuit enables releasing of welding of contacts in a short period by applying an bombardment pulse effective for welded contacts of the relay. Welded contacts of a relay are detected and subsequently input a signal to a microcomputer. A first driver is connected to an output port of the microcomputer which controls the relay, and a second driver is provided to another output port for driving the relay in parallel. This configuration allows to drive the first and second drivers alternately when contacts of the relay are welded, in order to apply an effective bombardment pulse for ensuring rapid separation of the welded contacts.

6 Claims, 6 Drawing Sheets

Commercial power supply

First driver

Second driver

Output port 1a

Output port 1b

Coil current of the relay

Contact of the relay
( 2a,2b )
a
b
c
d
e
f
g
h
i
j
k
l
m
n
o
(1)
(2)

Example of fusion release control pattern

Output port 1a

Output port 1b
A C E
B D
F G I
H J
K M
L N
basic mode
pressure mode
impact mode

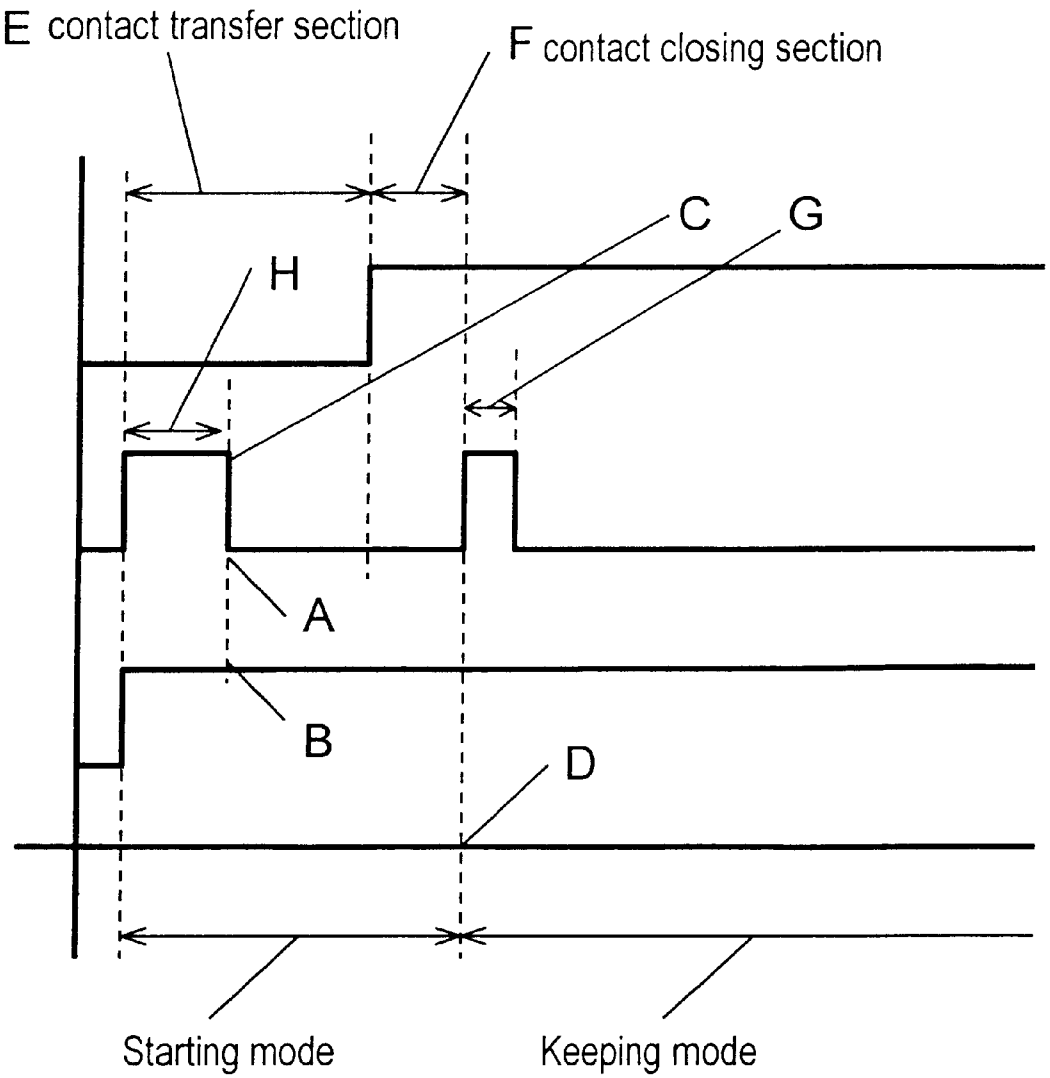
FIG. 4A Lode power
FIG. 4B Second driver
FIG. 4C First driver

CONTROLLER FOR RELAY

This application is a U.S. national phase application of PCT international application PCT/JP98/03995.

FIELD OF THE INVENTION

The present invention relates to the field of relay control circuits employed for driving and controlling relays using microcomputers.

BACKGROUND OF THE INVENTION

One known technology for controlling relays and releasing welded contacts autonomously using a microcomputer is configured as shown in FIG. 6. More specifically, reference numeral 21 is a microcomputer, reference numeral 21*a* is a +DC power supply VDD, and reference numeral 21*b* is a power supply VSS on a common line with the load power supply. A relay 22 is connected to a relay control output 21*c* of the microcomputer 21 through a driver transistor 23. A contact 24*a* of the relay 22 is connected to a power supply 26 through a load 25, and another contact 24*b* is connected to an input 21*d* of the microcomputer 21 to detect welding of the contact 24*a*.

Control operations when the contact is welded in the above configuration is briefly described below.

When the relay control output 21*c* of the microcomputer 21 switches from ON to OFF, the coil voltage of the relay 22 turns OFF, and the load 25 also turns OFF. At this point, if the relay 24*a* is welded, the contact 24*a* remains turned ON and the recovery signal from the contact 24*b* for detecting welded contacts will not return to the input 21*d* of the microcomputer 21, thus generating the message that welding has occurred. This switches the control signal from the relay control output 21*c* of the microcomputer 21 to the welded contact release mode, in which a short pulse signal is applied to the coil of the relay 22 to release the welded contacts. If the contacts separate immediately, the welding releasing mode returns to the normal control mode. If not, the welding releasing operation is repeated until the contact is released.

With the above conventional configuration, however, a rise time is typically required by the relay driving power supply before a subsequent pulse can be applied to release the welded contacts. This causes a lack of continuity in the release pulse, decreasing its effectiveness.

Moreover, if an instantaneous power failure occurs during normal operation of the relay and the driving power supply of the relay is regained without reaching a sufficient sensory voltage level, the relay contacts may remain turned off, or contact pressure may become insufficient. In the worst case, the contact may generate heat, resulting in degradation of the reliability of the entire piece of equipment.

SUMMARY OF THE INVENTION

A relay control circuit controls the load at a contact of the relay. The relay control circuit comprises a microcomputer for controlling the relay, a welded-contact detector for detecting welded contacts in the relay and subsequently inputting a signal to the microcomputer, and first and second drivers for switching the relay control signal of the microcomputer, in response to the signal from the contact welding detector, to a short pulse signal if the contact is welded. The first and second drivers are employed to drive the relay in parallel.

Using this configuration, if welding of the contact occurs, an bombardment pulse effective in releasing the contact can be applied by driving the relay in parallel, thus enabling rapid release of the welded contacts. When a recovery problem of the contact occurs due to insufficient rise of driving power, the contact can be recovered by supplying the relay driving signal from another output port provided in parallel.

BRIEF DESCRIPTION OF THE DRAWINGS

FIG. 4 is a timing chart illustrating another welding release control in accordance with the preferred embodiment.

FIG. 5(*b*) is an enlarged section view illustrating a contact condition of the relay.

DESCRIPTION OF THE PREFERRED EMBODIMENT

A preferred embodiment of the present invention is described next with reference to drawings.

Figure 1:
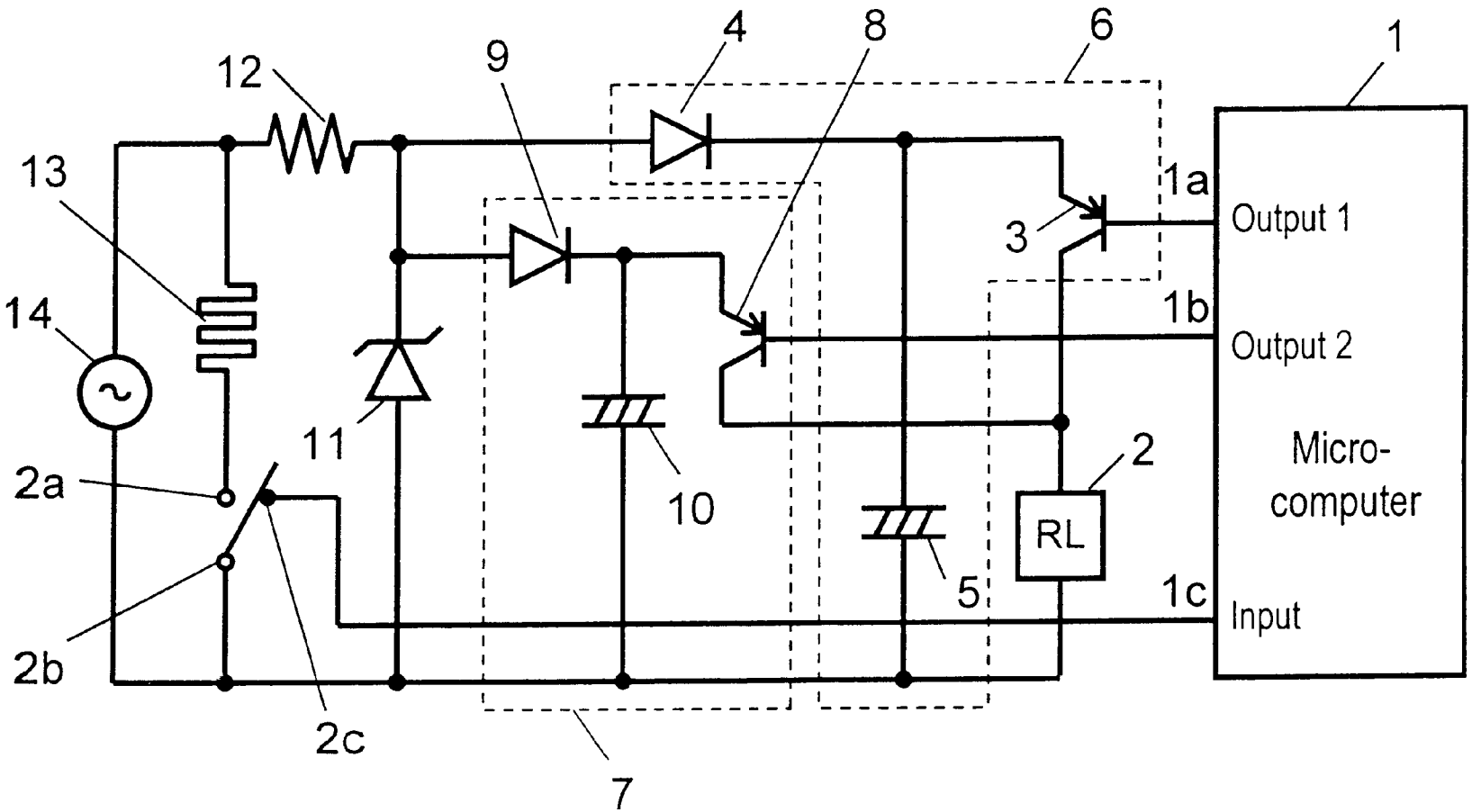
FIG. 1 is a circuit diagram showing a configuration of a control circuit of a relay in accordance with a preferred embodiment of the present invention.

FIG. 1 is a circuit diagram of a relay control circuit in a preferred embodiment of the present invention.

In FIG. 1, reference numeral 1 is a microcomputer, reference numeral 2 is a relay, and reference numeral 6 is a first driver which comprises a transistor 3, rectifying diode 4, and smoothing capacitor 5. Reference numeral 7 is a second driver which comprises a transistor 8, rectifying diode 9, and smoothing capacitor 10. Each base of the transistors 3 and 8 are respectively connected to the output ports 1*a* and 1*b* of the microcomputer 1. Each collector of the transistors 3 and 8 are connected in parallel to the relay 2.

Reference numeral 11 is a constant voltage element for securing voltage when driving the relay, and reference numeral 12 is a current limiting resistance for the constant voltage element, which also functions as a holding current limiting resistance for suppressing coil temperature rise during operation of the relay. Reference numeral 14 is a commercial power supply to which a load 13 is connected via contacts 2*a* and 2*b* of the relay. A contact 2*c* is used for detecting welding of the contacts 2*a* and 2*b*, and is connected to the input port 1*c* of the microcomputer 1.

The operation of the preferred embodiment is described next with reference to FIG. 1.

When a relay driving signal is output from the output port 1*a* of the microcomputer 1, the transistor 3 turns ON to apply the DC voltage charged to the smoothing capacitor 5 to the relay 2, and the relay 2 is driven. Accordingly, the contacts 2*a* and 2*b* of the relay are turned ON, and the current flows through the load 13. When the relay driving signal from the output port 1*a* of the microcomputer 1 is turned OFF, the input port 1*c* of the microcomputer 1 detects the signal indicating recovery of the contact 2*b* to the contact 2*c* of the relay.

If the contacts are welded and the recovery signal is not detectable, the output port 1*a* switches to output a short pulse signal from the first driver 6 to apply bombardment on the welded contacts. In addition, after applying a pulse from the first driver 6, a short pulse signal from the output port 1*b* of the microcomputer 1 is immediately applied by the second driver 7. Consecutive strong bombardment pulses from these output ports 1*a* and 1*b* continue until the welded contacts separate. Once the welded contacts have separated, the recovery level is regained at the contact 2*c*, and the input port 1*c* of the microcomputer 1 receives a signal indicating that the welded contacts have separated. The short pulse signal from the output port 1*a* is then switched to a normal operation signal. The output port 1*b* stops outputting signals, and nothing further is executed during normal operation except for the following operations.

Figures 2A, 2B, 2C, 2D, 2E, 2F, 2G:
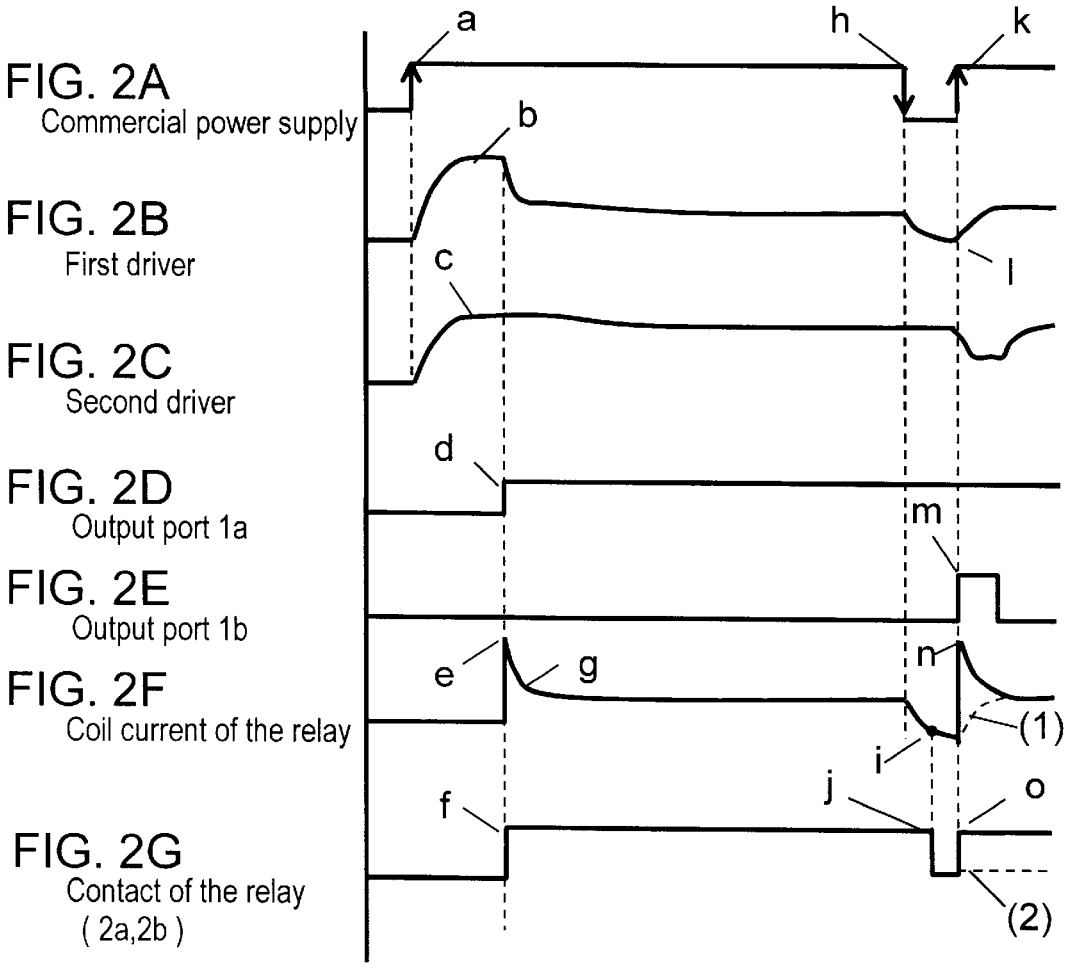
FIG. 2 is a timing chart illustrating effect at occurrence of instantaneous power failure in accordance with the preferred embodiment.

Other operations in this preferred embodiment shown in FIG. 1 are described with reference to FIG. 2.

The operations which follow when instantaneous power failure of the commercial power supply occurs in the circuit diagram shown in FIG. 1 are described with reference to FIG. 2. If the commercial power supply 14 is applied at Point a, the DC power supply of the microcomputer 1 is supplied at approximately the same time. The driving power supply of the relay 2, as described above, drives the relay 2 using the voltage charged in the smoothing capacitor, suppressing any temperature rise of the coil of the relay 2. After it is activated, the driving current is maintained at the minimum required holding current by limiting the driving current by means of the current limiting resistance 12.

Accordingly, the voltage of the first driver 6 of the relay 2 settles to a predetermined level at Point b, slightly later than the point of the input power supply, depending on the time constant of the smoothing capacitor 5 and the resistance 12. In general, the time involved is shorter than a few seconds, showing no problem in practical use. In the same way, the voltage of the second driver 7 settles to a predetermined level at Point c. When the control signal of the relay 2 is output from the output port 1*a* of the microcomputer 1 at Point d, the high voltage at Point e stored in the smoothing capacitor 5 at Point e is applied to the relay 2. When the contacts of the relay 2 close at Point f, the coil current of the relay 2 levels out at the minimum required holding current at Point g.

If instantaneous power failure suddenly occurs at Point h, the voltage level of the first driver 6 drops, reducing the coil current to below the holding voltage at Point i. In this case, the contacts of the relay 2 open at Point j. Even if the power failure is recovered at Point k, the control signal from the output port 1*a* of the microcomputer 1 remains ON. Accordingly, the voltage for restarting the relay 2 cannot be expected to match that at Point (1). The contact of the relay 2 remains open as shown by Point (2), which means the load cannot be driven. Even if the contact point is closed, sufficient contact pressure cannot be secured due to reasons such as heat generation at the contact, which may degrade reliability. Therefore, after power is regained, the control signal for the second driver 7 is output at Point m from the output port 1*b* of the microcomputer 1 so that the relay 2 gains a high coil current at Point n, making the contact return to its normal state at Point o.

The control circuit of the relay 2 as operated above enables the rapid release of welded contacts by applying an effective bombardment pulse using more than one driving circuit when the contacts are welded. At the same time, the contact can be recovered by supplying the driving signal from another parallel output port even if there is a problem with recovery of the relay due to insufficient rise of driving power. Accordingly, the present invention has the advantageous effect of providing a relay control circuit that solves all these problems at the same time.

Next, the operation of parallel driving based on more than one control pattern programmed by the microcomputer is described with reference to FIG. 3.

Figures 3A, 3B:
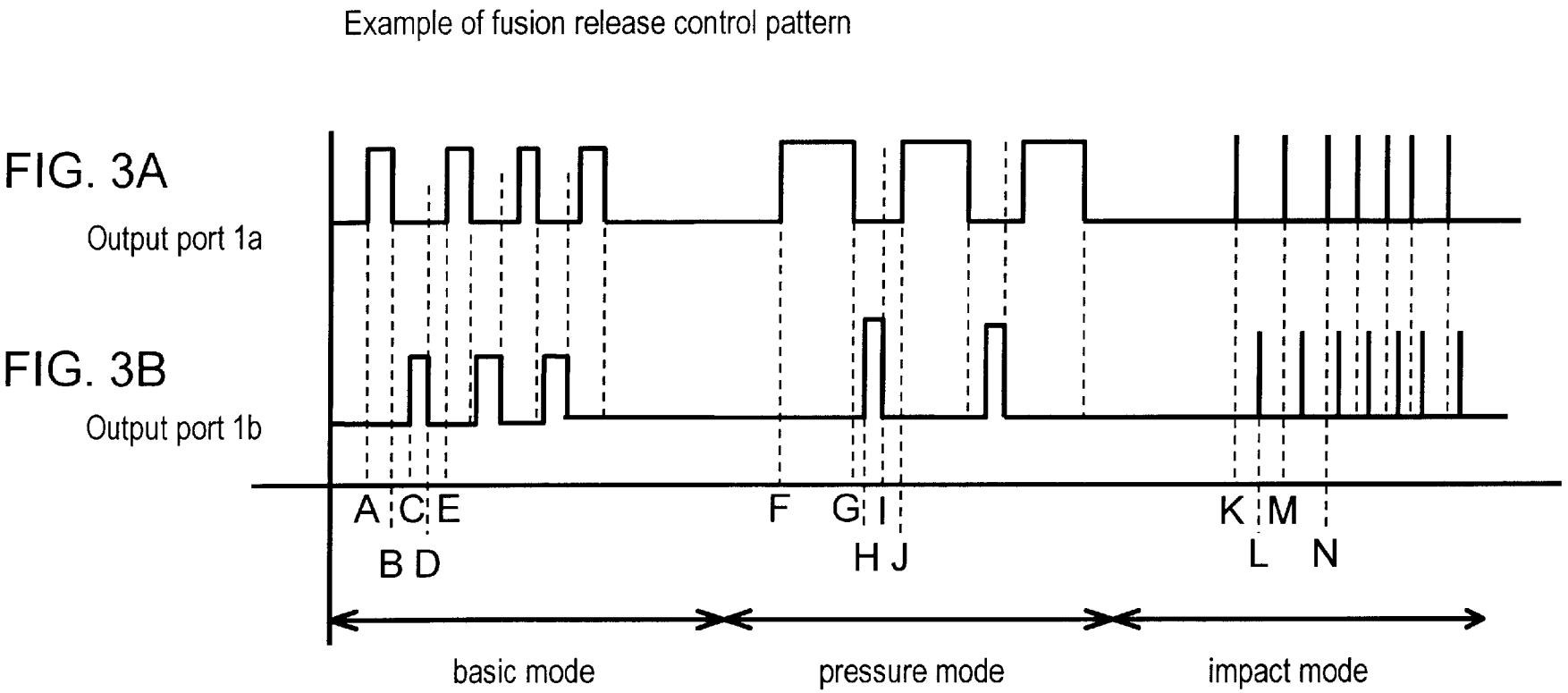
FIG. 3 is a timing chart illustrating a welding release control pattern in accordance with the preferred embodiment.

FIG. 3 illustrates the control pattern output from the output ports 1*a* and 1*b* when the input port 1*c* of the microcomputer detects a welded contact. The control signal for the relay 2, switched to a short pulse signal (approximately 500 ms), is output from the output port 1*a* at Point A. When this pulse signal is cut off at Point B, a control signal is output from the output port 1*b* at Point C, allowing time to turn OFF the contact of the relay 2. The same operations are repeated at points D and E until the welded contacts are separated. This is the basic mode of operation.

Next, in the pressure mode, a slightly longer pulse (500 ms to 1 s) is output at Point F, and then cut off at Point G. Then, as described above, a short pulse is output from the output port 1*b* at Point H, providing sufficient time to turn OFF the contact of the relay 2. The same operations are repeated at Points I and J until the welded contacts are separated.

In the bombardment mode, an extremely short pulse (200 ms maximum) is output from the output port 1*a* at Point K. The extremely short pulse is also output from the output port 1*b* at Point L, allowing sufficient time to turn OFF the contact of the relay 2. The same operations are repeated at Points M and N until the welded contacts are separated.

The above three modes can be executed independently, combined, or combined and rearranged. A wide range of applications are achievable by creating programs that gain the most effective results.

As described above, by alternately driving the first driver and second driver for the control signal of the relay based on more than one control pattern programmed by the microcomputer, an bombardment pulse effective in separating the welded contacts is applied in a short period, ensuring the effect of releasing the welded contacts. At the same time, the inching operation, which was conventionally thought to be problematic, becomes feasible.

Furthermore, other effects are achievable by creating a program as shown in FIG. 4, which is described next.

In FIG. 4, if the driving signal for the relay is input at Point A, the first driver 6 and second driver 7 are activated at almost the same time. The contact of the relay coil closes vigorously in the initial period (A to B) in the contact transfer section E as a result of the second driver 7 applying the maximum voltage for driving the relay. Then, after Point B, the relatively low voltage of the first driver 6 is applied during the rest of the contact operation section, and the operation then proceeds to the contact closing section (C to D).

This series of operations in the starting mode achieves two effects. One is to suppress deviations in the operating period as a result of mechanical friction at starting operation. This is achieved by forcibly driving the contact with the second driver 7 during the contact transfer section E (A to C). Accordingly, the above operation is an effective means for reducing repeated deviations.

Another effect is the suppression of mechanical bombardment noise when closing the contact by driving in the low-voltage mode, using the minimum required voltage, between the last part (B to C) of the contact transfer section E and the contact closing section F. Accordingly, the above operation is an effective means for reducing relay noise. In addition, by outputting the relay driving signal G from the second driver 7 after completing the contact closing section F, the adsorption power of the coil can be reinforced to secure full contact pressure even if it is insufficient when closing the contact. The relation of the driving period of the first driver 6 and the second driver 7 can be expressed using the following formula:

$E \times k > H$ in which

E=Time of the contact transfer section k=Coefficient of 0.1 to 0.9

H=Operating period of the second driver.

Figure 5A:
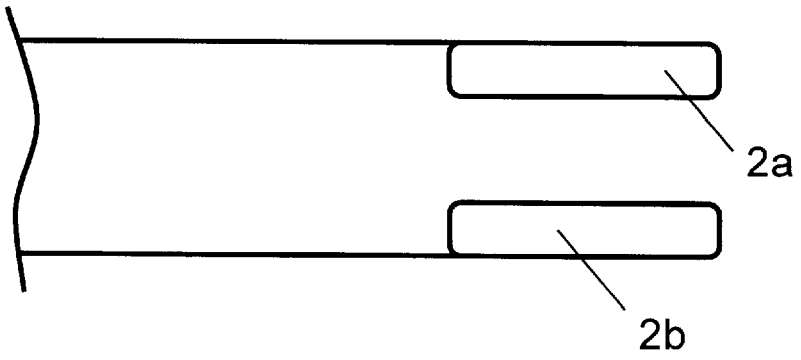
FIG. 5(*a*) is an enlarged view of the relay in accordance with the preferred embodiment.
Figure 5B:
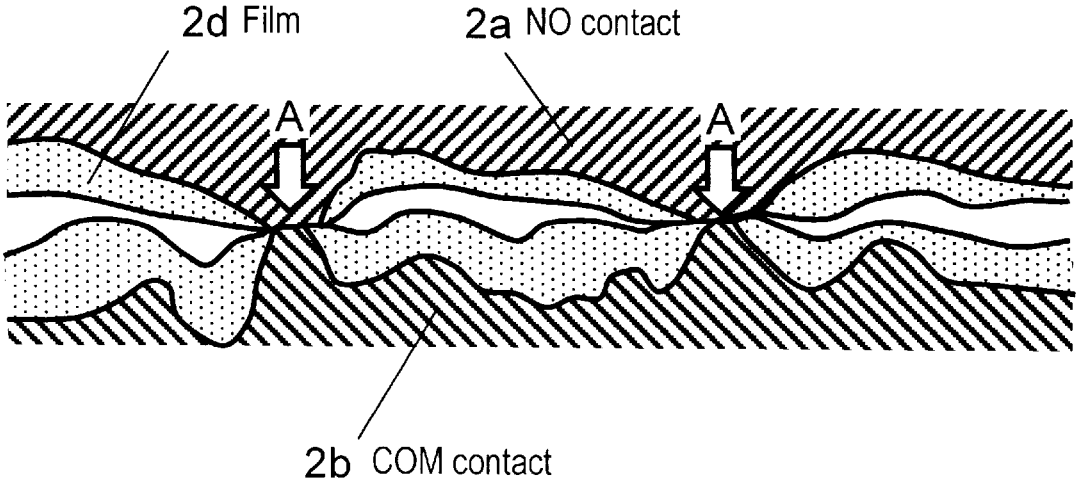
Figure 6:
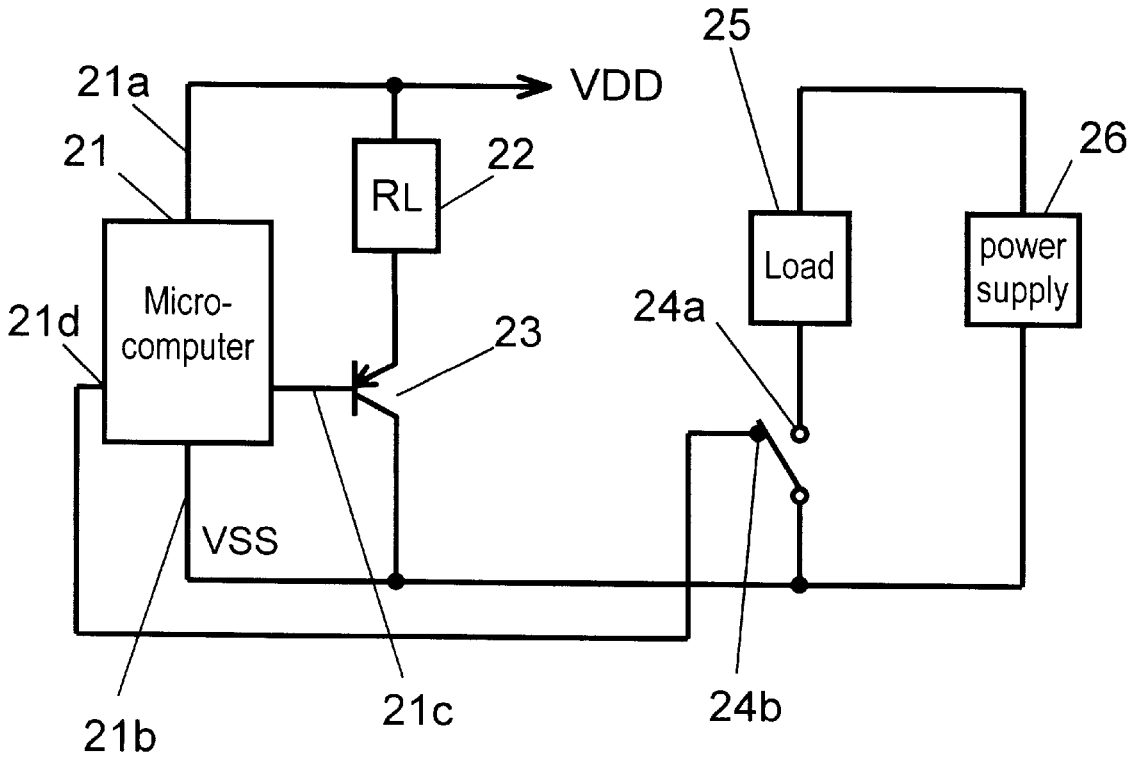
FIG. 6 PRIOR ART
FIG. 6 is a control circuit diagram of a relay employing a conventional welding releasing method.

The following FIGS. 5(*a*) and 5(*b*) show a model of the state of a contact portion of the relay used in this preferred embodiment. In these figures, the reference numeral 2*a* is NO contact (fixed contact) and the reference numeral 2*b* is COM contact (movable contact). A film (2*d*) such as an oxidized or contaminated film is adhered to the surface of these contacts. As illustrated in the Figures, more than one metal micro-protrusion contact each other just by their tips (arrow A) when the current flows. Thus a current flow route is formed.

Accordingly, in the preferred embodiment, if the first driver is driven by a voltage lower than the rated voltage of the relay within the controllable range of the relay, the area of melted and welded portions can be minimized if contact welding occurs for any reason. Extension of micro-protrusions on the contact surface can also be minimized. This suppresses to minor welding, and even prevents occurrence of minor welding. In addition, the bouncing phenomenon that occurs when the contact is turned ON can be minimized by applying low voltage, resulting in a marked extension of the service life of the contact.

It should be noted that the capability for autonomously releasing the welded contacts decline at lower driving voltages. In other words, the knocking pulse becomes weaker. However, a stronger bombardment can be applied by setting the driving voltage of the second driver higher than that of the first driver (for example, greater than the rated voltage but within the maximum rating), and driving the first and second drivers in parallel. This also allows to secure sufficient autonomous releasing capability.

Industrial Applicability

As described above, a relay control circuit the application of an bombardment pulse effective in separating the welded contacts by driving the relay in parallel. This achieves rapid release of the welded contacts. The contact can also be recovered by supplying the driving signal to the relay from another output port provided in parallel even if problems arise with recovery of the relay due to insufficient rise of the driving power supply.

Moreover, the most effective bombardment pulse can be applied by alternately driving the first driver and second driver, which is to drive the relay in parallel, based on more than one control pattern programmed into the microcomputer.

Furthermore, since the first driver is driven at a lower than rated voltage, if any welding does occur, it will be minor. Extension of micro-protrusions on the contact surface can be prevented because little bouncing takes place when the contact is turned ON. This significantly extends the service life of the contact, and enables the application of a strong bombardment on the welded portion, since the second driver is driven at a voltage larger than the rating if contact welding occurs.

Furthermore, the second driver is forcibly but temporarily operated at the maximum driving voltage of the relay in the starting mode to suppress deviations at startup as a result of mechanical friction during the initial period of operation of the relay. This reduces deviations in repeated operation time. Then, the contact is closed by the first driver at the minimum driving voltage required, achieving the advantageous effect of reducing the noise level during relay operation.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A relay control circuit for controlling load at contacts of a relay, comprising:

a microcomputer for controlling said relay;

a welded contact detector for detecting that said contacts are welded, and for subsequently inputting a signal to said microcomputer; and first and second drivers for switching a relay control signal of said microcomputer from a normal signal to provide a short pulse signal at said welded contacts based on said signal from said welded contact detector;

wherein said first and second drivers are coupled in parallel for driving said relay.

2. The relay control circuit as defined in claim 1, wherein driving voltages of said first and second drivers are different.

3. The relay control circuit as defined in claim 1, wherein said first and second drivers are controlled with a different control pattern respectively to drive the relay in parallel at said welded contacts, each of said control patterns programmed in the microcomputer.

4. The relay control circuit as defined in claim 1, wherein said first driver is driven at a voltage smaller than the rating of the relay, and said second driver is driven at a voltage greater than the rating of said relay but within the maximum rating.

5. The relay control circuit as defined in claim 1, wherein said second driver is forcibly driven temporarily at approximately the maximum driving voltage of the relay at startup, and then said first driver is driven at a minimum required voltage.

6. The relay control circuit as defined in claim 1, wherein said first driver is controlled with a control pattern continuously and said second driver is controlled with a control pattern intermittently.

* * * * *